United States Patent [19]

Westhoff et al.

[11] Patent Number: 4,880,528

[45] Date of Patent: Nov. 14, 1989

[54] METHOD AND APPARATUS FOR HYDROCARBON RECOVERY FROM TAR SANDS

[75] Inventors: James D. Westhoff; Arnold E. Harak, both of Laramie, Wyo.

[73] Assignee: The United States of America as represented by the United States Department of Energy, Washington, D.C.

[21] Appl. No.: 188,324

[22] Filed: May 4, 1988

[51] Int. Cl.[4] ..... C10G 1/02

[52] U.S. Cl. ..... 208/409; 208/427

[58] Field of Search ..... 208/409, 427

[56] References Cited

U.S. PATENT DOCUMENTS

| | | | |
|---|---|---|---|
| 4,229,185 | 10/1980 | Sass | 208/409 |
| 4,269,696 | 5/1981 | Metrailer | 208/427 |
| 4,340,463 | 7/1982 | Harak | 208/427 |
| 4,448,668 | 5/1984 | Deering | 208/409 |
| 4,459,201 | 7/1984 | Eakman et al. | 208/409 |
| 4,530,752 | 7/1985 | Deering et al. | 208/427 |

OTHER PUBLICATIONS

Harak et al, "A Cyclone Oil Shale Retorting Concept," Fossil Energy, pp. 1-54, DOE/METC/84-20 (DE84009281).

*Primary Examiner*—Asok Pal

*Attorney, Agent, or Firm*—Earl L. Larcher; Stephen D. Hamel; Judson R. Hightower

[57] ABSTRACT

A method and apparatus for utilizing tar sands having a broad range of bitumen content is disclosed. More particularly, tar sands are pyrolyzed in a cyclone retort with high temperature gases recycled from the cyclone retort to produce oil and hydrocarbon products. The spent tar sands are then burned at 2000° F. in a burner to remove residual char and produce a solid waste that is easily disposable. The process and apparatus have the advantages of being able to utilize tar sands having a broad range of bitumen content and the advantage of producing product gases that are free from combustion gases and thereby have a higher heating value. Another important advantage is rapid pyrolysis of the tar sands in the cyclone so as to effectively utilize smaller sized reactor vessels for reducing capitol and operating costs.

9 Claims, 1 Drawing Sheet

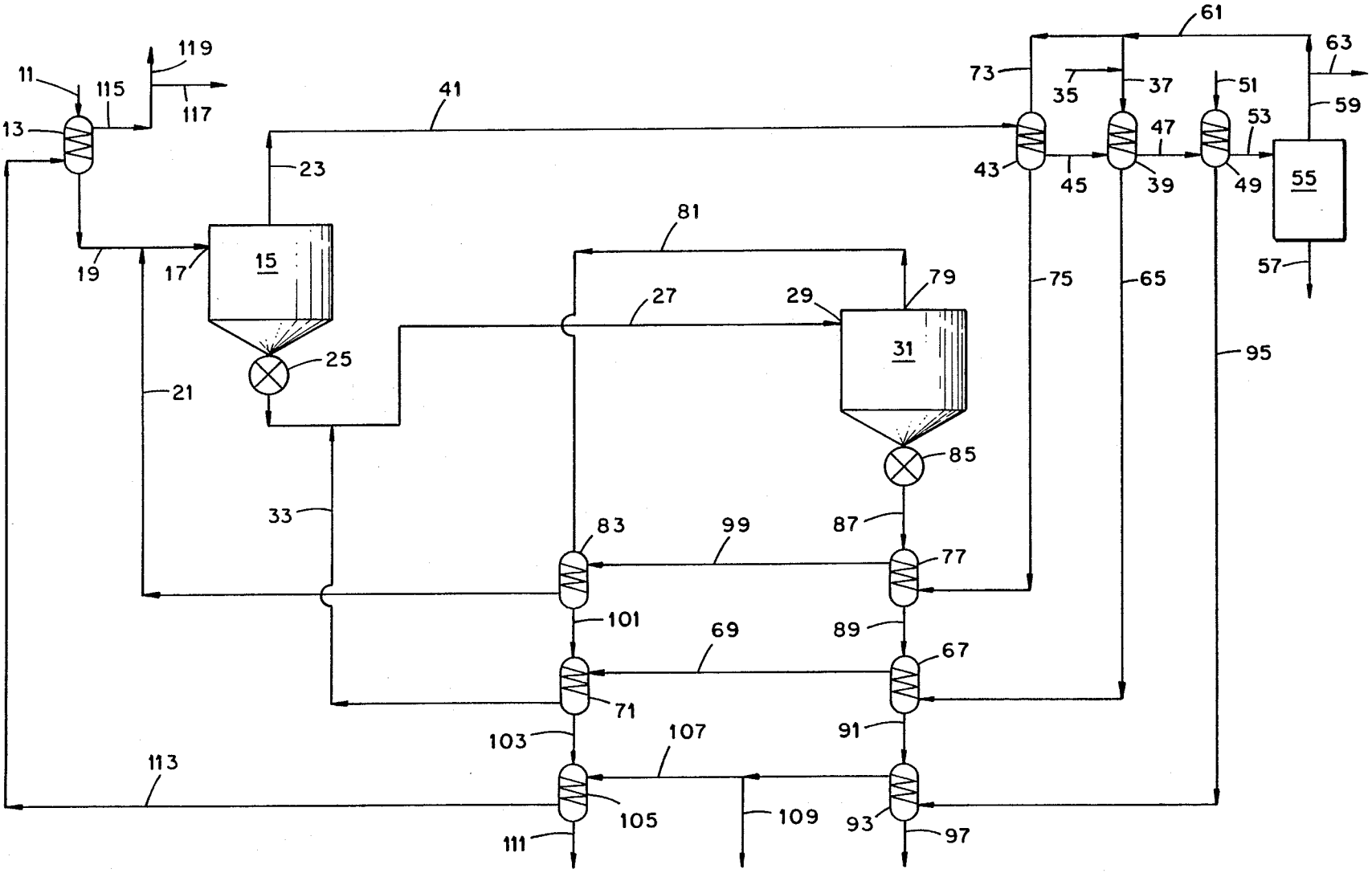
55
31
15
11
13
17
19
21
23
25
27
29
33
35
37
39
41
43
45
47
49
51
53
57
59
61
63
65
67
69
71
73
75
77
79
81
83
85
87
89
91
93
95
97
99
101
103
105
107
109
111
113
115
117
119

METHOD AND APPARATUS FOR HYDROCARBON RECOVERY FROM TAR SANDS

FIELD OF THE INVENTION

The present invention relates to a method and apparatus for utilizing tar sands having a broad range of bitumen content and which rapidly pyrolyzes tar sands to produce oil and other hydrocarbon products.

BACKGROUND OF THE INVENTION

A major effort to recover the hydrocarbon values from tar sands on a commercial scale was started with the official opening of the great Canadian oil sands plant in 1967. A great deal of research and experimentation preceded this event and research efforts are still continuing. The ultimate objectives of the research have been to improve the quality and quantity of the recovered hydrocarbon products and to improve the environmental acceptance of the overall process.

Processes for recovering oil from carbonaceous material such as oil shale have existed for some time. One such process is described in U.S. Pat. No. 4,340,463 (Harak) issued July 20, 1982. In this patent a system is provided for utilizing fines of carbonaceous materials to obtain the maximum utilization of the energy content of the fines and produce a waste which is relatively inert and of a size to facilitate disposal. The process involves employing a cyclone retort which pyrolyzes the fines in the presence of heated gaseous combustion products. The cyclone retort has a first outlet through which vapors can exit that can be cooled to provide oil and a second outlet through which spent shale fines are removed. A burner connected to the spent shale outlet of the cyclone retort burns the spent shale with air to provide hot combustion products that are carried back to the cyclone retort to supply gaseous combustion products used therein. The burner heats the spent shale to a temperature at which it forms a molten slag and the molten slag is removed from the burner into a quencher that suddenly cools the molten slag to form granules that are relatively inert and of a size that is convenient to handle for disposal in the ground or in industrial processes.

This oil shale process, however, suffers from several drawbacks. First, the gases produced by this process are diluted with combustion products and thus their heating value is much reduced. Second, this process lacks the flexibility necessary for hydrocarbon recovery from tar sands because tar sands of different types will have a broad range of bitumen content. Thus, there is a need for a process which does not dilute the hydrocarbon gases produced with combustion products and which is capable of utilizing tar sands having a broad range of bitumen content.

SUMMARY OF THE INVENTION

A first embodiment of the present invention relates to an apparatus for utilizing tar sands having a broad range of bitumen content. The apparatus includes a cyclone retort chamber having an inlet for receiving tar sands and hot gases, a means for circulating tar sands around the retort chamber whereby the tar sands are maintained in a fluidized state with hot gases, a gas outlet for removing gases from the chamber and a spent sand outlet for removing spent sand material from the chamber. The apparatus also includes a burner for burning the spent sand material to generate gaseous combustion products. The burner has an inlet coupled to the spent sand outlet of the retort chamber and an outlet for removing gaseous combustion products therefrom. Finally, the apparatus includes heat exchange means having a first inlet coupled to the cyclone retort chamber gas outlet and a second inlet coupled to the burner outlet. The heat exchange means also includes a first outlet coupled to the cyclone retort chamber inlet and a second outlet for removing cooled gaseous combustion products. The heat exchange means is connected such that at least some of the gases removed from the cyclone retort chamber are heated by heat exchange with the gaseous combustion products from the burner and are fed back to the cyclone retort chamber.

In a second embodiment, the present invention relates to a method for utilizing tar sands to form hydrocarbon products. In the method, the tar sands are pyrolyzed with hot gases in a cyclone retort chamber by maintaining the tar sands circulating around the chamber in a fluidized state with hot gases. Gases are removed from the retort chamber and the spent sand is also removed from the retort chamber. The removed gases are cooled to recover oil and hydrocarbon products therefrom. The removed spent sand is burned in a cyclone-type burner to generate hot combustion gases and to heat the spent sand to a high temperature of approximately 2,000° F. The hot combustion gases are also removed from the burner and are used for heat exchange with a fraction of the gases removed from the retort chamber to thereby heat the gases from the retort chamber. Finally, the cooled combustion gases are discarded and the heated fraction of the gases removed from the retort chamber are fed back into the cyclone retort chamber along with additional tar sands.

It is the primary object of the invention to provide a relatively rapid pyrolysis process which will utilize tar sand having a broad range of bitumen content.

It is further object of the present invention to pyrolyze tar sands to produce hydrocarbon gases which are not diluted with combustion products.

It is a still further object of the present invention to produce, from tar sands, hydrocarbon gases which have a high heating value.

It is a still further object of the present invention to provide discharge sand which has the char or carbonaceous residue completely burned off to thereby minimize environmental problems associated with disposal of the spent sand.

These and other objects of the present invention will be apparent to one of ordinary skill in the art from the detailed description which follows.

BRIEF DESCRIPTION OF THE DRAWING

The single FIGURE is a diagrammatic view of a preferred embodiment of a system for utilizing tar sands in accordance with the present invention.

DETAILED DESCRIPTION OF THE PREFERRED EMBODIMENT

The present invention relates to a system for utilizing tar sand having a broad range of bitumen content. A detailed description of the composition of tar sands can be found in an article entitled "Great Canadian Oil Sands Experience in the Commercial Processing of Athabasca Tar Sands", Andrews, G. F. and Lewis, H. M., American Chemical Society, Division of Fuel Chemistry, volume 12, number 1, 1968, which is hereby incorporated by reference.

The single FIGURE illustrates a system for utilizing tar sands to produce oil and other fossil-derived products and to provide energy that can be utilized on site. For example, the tar sands produce energy which can be used to generate electrical power. Further, the tar sands produce an essentially inert and uniform-sized waste that can be easily disposed of either in the ground or can be utilized in industry.

The system includes a tar sand inlet 11 for feeding tar sands into a heat exchanger 13. From heat exchanger 13, the tar sands are fed to pyrolysis cyclone retort 15 through cyclone inlet 17 by line 19. Also connected to line 19 is gas line 21 for providing hot, substantially non-oxidizing gases to line 19 that provide the heat to enable operation of cyclone retort 15. By substantially non-oxidizing gases, it is meant gases having very little and preferably no free oxygen present to oxidize the tar sand products in cyclone retort 15. Cyclone retort 15 also includes gas outlet 23 for removing gases from cyclone retort 15 and sand outlet 25 for removing spent tar sands from cyclone retort 15. The tar sands and hot gases enter cyclone retort 15 where the heat of the gases heat the tar sands to rapidly pyrolyze them. The reaction releases a gas-oil mist as well as spent tar sands all of which exit cyclone retort chamber 15 through gas outlet 23. The larger pyrolyzed sand granules drop to the bottom of cyclone chamber 15 and are removed through sand outlet 25.

The spent sand which passes through sand outlet 25 is fed to a cyclone furnace or burner 29 through line 27 where it is burned with air which enters line 27 from line 33. The air is fed through air inlet 35 to line 37 and thence to heat exchanger 39 where it is heated by heat exchange with the gases removed from cyclone retort chamber 15 through gas outlet 23 and line 41. These gases, removed from cyclone retort chamber 15, are fed through line 41 to heat exchanger 43 where they are cooled in contact with recycle-gas. The gases removed from cyclone retort chamber 15 exit heat exchanger 43 through line 45 which leads to heat exchanger 39 wherein they are further cooled by heat exchange with air and additional gases. From heat exchanger 39, the gases removed from cyclone retort chamber 15 continue through line 47 to heat exchanger 49 where they are still further cooled to room temperature by heat exchange with water fed through water inlet 51. Finally, the gases removed from cyclone retort chamber 15 leave heat exchanger 49 through line 53 which feeds them to separator 55 wherein the condensed liquids are separated from the remaining gases. The condensed liquids leave separator 55 through outlet 57, and oil is among the condensed liquids. The remaining gases leave separator 55 through outlet 59. Part of the gas stream exiting through outlet 59 is used as recycle-gas by being fed to line 61. The remainder of the gases leaving through outlet 59 are taken off as product gases through product outlet 63.

The recycle gas in line 61 is then further divided into two streams which are both heated by heat exchange. The first stream passes through line 37 where it is mixed with air and fed to heat exchanger 39 where it is heated by heat exchange with the gases removed from cyclone retort chamber 15. This heated mixture of recycle-gas and air then proceeds into line 65 which feeds it to heat exchanger 67 which further heats the air and recycle gas mixture. Finally, the air and recycle-gas mixture leaves heat exchanger 67 through line 69 by which it is fed to heat exchanger 71 wherein the mixture is further heated by heat exchange with combustion products from burner 31. The heated air and recycle-gas mixture leaves heat exchanger 71 through line 33 and is then mixed with spent tar sands in line 27 and fed to burner 31 where the tar sands are burned at a relatively high temperature of about 2,000° F. which substantially completely oxidizes all organic material in the spent tar sands.

As a result of burning the spent sand and supplementary fuel, ash is generated at a high temperature. This granular, high-temperature ash leaves burner 31 through outlet 85 where it is fed through line 87 to heat exchanger 77 to begin cooling of the ash. The ash is cooled in heat exchanger 77 by heat exchange with a portion of recycle-gas from line 61 which is fed through line 73 to heat exchanger 43 wherein the recycle-gas is first heated by contact with gases removed from cyclone retort chamber 15. The partially heated recycle-gas is then fed from heat exchanger 43 through line 75 to heat exchanger 77 where it serves to cool ash from burner 31. The partially cooled ash is then fed from heat exchanger 77 through line 89 to heat exchanger 67 wherein it is further cooled by heat exchange with the air and recycle-gas mixture from line 65. Finally, the partially cooled ash is fed from heat exchanger 67 through line 91 to heat exchanger 93 where it is cooled to its final temperature by heat exchange with cooling water fed through water inlet 51. The cooling water used for heat exchange in heat exchanger 93 has already been partially heated in heat exchanger 49 by heat exchange with gases removed from cyclone retort chamber 15 and this water is fed from heat exchanger 49 to heat exchanger 93 through line 95. The completely cooled ash leaves heat exchanger 93 through line 97. This ash has all of the char burned off and thus most, if not all, of the environmental problems related to disposal of this ash are eliminated.

Gaseous combustion products or flue gases leave burner 31 through outlet 79 and are fed through line 81 to heat exchanger 83 wherein they are cooled by heat exchange with recycle-gases from heat exchanger 77 which are fed to heat exchanger 83 through line 99. The heated recycle-gas then proceeds from heat exchanger 83 to line 21 and is fed back into cyclone retort chamber 15 through inlet 17 along with fresh tar sands. The partially cooled combustion gases from heat exchanger 83 are then fed through line 101 to heat exchanger 71 for further heat exchange with the air and recycle-gas mixture in order to further cool the combustion gases. From heat exchanger 71, the combustion gases are fed through line 103 to heat exchanger 105 for final cooling in contact with water from heat exchanger 93 which is fed through line 107 to heat exchanger 105. Not all the water from heat exchanger 93 is necessary for cooling the combustion products in heat exchanger 105 and thus some of the water is removed through water outlet 109 and may be used for other purposes. The cooled combustion products are finally removed from heat exchanger 105 through outlet 111. The remaining steam is passed from heat exchanger 105 through line 113 back to heat exchanger 13 to heat the incoming tar sands prior to feeding the tar sands to pyrolysis cyclone chamber 15. The partially cooled steam exits heat exchanger 13 through line 115 and is divided into a water component which exits through outlet 117 and steam component which exits through outlet 119.

A typical example of a cyclone retort chamber 15 is shown in FIG. 2 of U.S. Pat. No. 4,340,463 issued on July 20, 1982, which is hereby incorporated by reference.

The present invention provides a processing sequence for processing tar sands based on operations that have been used successfully in industry for the generation of hot gases, or for high temperature rapid reactions of solids with gases. The equipment, heat exchangers, phase separators, and feeders are standard units used in industry. The present invention improves the recovery of hydrocarbon products by producing a gas stream that is not diluted by combustion products and improves the environmental acceptability of the waste products by removing the carbonaceous material from the sand before it is discharged and disposed of.

The spent tar sand containing carbonaceous residue or char is fed from the pyrolysis cyclone retort chamber 15 to burner 31 where it is burned at about 2,000° F. with air and preheated by heat exchange with hydrocarbon products, sand and combustion products. Depending upon the bitumen content of the tar sands being process, additional fuel may be required to supply the energy needs of the process. For example, for tar sands containing 6.0 weight percent bitumen, all of the product gas and part of the product oil must be burned to supply the energy needs of the process. The relative amounts of product gas and oil being burned could be adjusted if there was an economic requirement for the production of additional gas. For a 9.5 weight percent bitumen content in the tar sands, less than half of the product gas would need to be burned to supply sufficient energy for the process. For tar sands containing 14.14 weight percent bitumen, such as that found in the Athabasca tar sands, the char provides more than enough energy for the process.

The cyclone retort chamber operates on a cyclone principle, wherein the tar sands and recycle-gases enter tangentially to move in a spiral through the retort chamber 15, to keep the tar sands suspended in the recycle-gases. This cyclone process helps avoid the formation of clinkers which can occur in other retorts as a result of the fusing together of small particles. Furthermore, according to the present invention, a retort chamber which is relatively small in size is adequate because the pyrolysis occurs rapidly. The cyclone retort enables such pyrolyzing to be performed with relatively small particles that can be suspended in a rapidly moving gas stream, including relatively large particles of up to about ½-inch size as well as small particles.

The following example is provided to illustrate a specific embodiment of the present invention.

EXAMPLE 1

This example provides all process parameters for oil and gas production from a tar sands charge containing 9.5 weight percent bitumen. The table below indicates all of the process parameters to generate 3,000 bbl/day of oil from tar sands having 9.5 weight percent bitumen content.

TABLE 1

| Feed Streams | Amount, lb/hr | Type |
|---|---|---|
| 11 | 620,925 | Tar Sands |
| 35 | 156,803 | Air |
| 51 | 212,343 | Water |
| **Product Streams** | **Amount** | **Type** |
| 63 | 6,439 | Product Gas |

TABLE 1-continued

| | | |
|---|---|---|
| 57 | 41,527 | Liquid Oil |
| 97 | 561,938 | Sand (Ash) |
| 109 | 118,803 | Water |
| 111 | 167,825 | Combustion Products |
| 117 | 1,631 | Water |
| 119 | 91,909 | Steam |

Temperatures at Various Points in Process

| Stream | Temperature, °F. |
|---|---|
| 11 | 77 |
| 15 | 1,022 |
| 19 | 278 |
| 21 | 1,996 |
| 27 | 1,022 |
| 31 | 2,000 |
| 33 | 1,990 |
| 35 | 77 |
| 37 | 77 |
| 41 | 1,022 |
| 45 | 407 |
| 47 | 297 |
| 51 | 77 |
| 53 | 77 |
| 57 | 77 |
| 61 | 77 |
| 63 | 77 |
| 65 | 403 |
| 69 | 1,033 |
| 73 | 77 |
| 75 | 999 |
| 81 | 2,000 |
| 87 | 2,000 |
| 89 | 1,033 |
| 91 | 843 |
| 95 | 190 |
| 97 | 190 |
| 99 | 1,994 |
| 101 | 1,994 |
| 103 | 1,102 |
| 107 | 212 |
| 109 | 212 |
| 111 | 473 |
| 113 | 900 |
| 115 | 212 |
| 117 | 212 |
| 119 | 212 |

| Tar Sands Properties | |
|---|---|
| Tar Sands Charge | 620,925 lb/hr |
| Bitumen Content | 9.5 wt. % |
| Potential Oil Yield | 3,000 Bbl/day |
| Potential Gas Yield | 11,857 lb/hr |
| Potential Char Yield | 5,604 lb/hr |

| Process Results | |
|---|---|
| Char Burned | 5.604 lb/hr |
| Oil Burned | 0 |
| Gas Burned | 5,418 lb/hr |
| Oil Produced | 45,527 lb/hr or 3,000 Bbl/day |
| Gas Produced | 3,439 lb/hr |
| $H_2S$ Free Gas Produced | 83,639 scf/hr |
| Discharged Sand Ash | 561,938 lb/hr |

EXAMPLE 2

This example is based on tar sands having a bitumen content of 6.0 weight percent.

| Tar Sands Properties | |
|---|---|
| Bitumen Content | 6.0 wt % |
| Tar Sands Charge | 983,132 lb/hr |
| Potential Oil Yield | 3,000 Bbl/day |
| Potential Gas Yield | 11,857 lb/hr |
| Potential Char Yield | 5,604 lb/hr |
| **Process Results** | |
| Char Burned | 5,604 lb/hr |

-continued

| | |
|---|---|
| Oil Burned | 2,341 lb/hr |
| Gas Burned | 11,855 lb/hr |
| Oil Produced | 39,187 lb/hr or 2,831 Bbl/day |
| Gas Produced | 0 |
| $H_2S$ Free Gas Produced | 0 |
| Discharged Sand Ash | 924,144 lb/hr |

EXAMPLE 3

This example is based on tar sands having a bitumen content of 14.14 weight percent.

| Tar Sands Properties | |
|---|---|
| Bitumen Content | 14.14 wt % |
| Tar Sands Charge | 417,171 lb/hr |
| Potential Oil Yield | 3,000 Bbl/day |
| Potential Gas Yield | 11,857 lb/hr |
| Potential Char Yield | 5,604 lb/hr |
| **Process Results** | |
| Char Burned | 5.604 lb/hr |
| Oil Burned | 0 |
| Gas Burned | 0 |
| Oil Produced | 41,527 lb/hr or 3,000 Bbl/day |
| Gas Produced | 11,856 lb/hr |
| $H_2S$ Free Gas Produced | 154,007 scf/hr |
| Discharged Sand | 358,183 lb/hr |

Although particular embodiments of the invention have been described and illustrated herein, it is recognized that modifications and variations may be made by those of ordinary skill in the art and consequently, it is intended that the claims define the scope and content of the invention.

What is claimed is:

1. A method for utilizing tar sands having a broad range of bitumen content comprising:

rapidly pyrolizing the tar sands in a retort having a cyclone chamber by maintaining the tar sands circulating around the chamber in a fluidized state with hot gases, removing gases from the retort, and removing spent tar sands from the retort;

cooling the gases removed from the retort to remove oil therefrom;

burning the spent tar sands in a burner to generate combustion gases and to heat the spent tar sands to a high temperature sufficient to maintain the ash as granular;

heating at least part of the cooled gases removed from the retort by heat exchange with the combustion gases from the burner, feeding the heated gases removed from the retort back to the retort along with fresh tar sands; and removing the granular ash from the burner and cooling it.

2. A method in accordance with claim 1 wherein said burning step further comprises feeding at least some of the heated gases removed from the cyclone retort to the burner to raise the temperature therein to a level at which essentially complete combustion occurs.

3. A method in accordance with claim 2 wherein said burning step further comprises feeding at least some of the recovered oil to the burner to thereby raise the temperature therein to a level at which the ash is essentially completely combusted.

4. A method in accordance with claim 1 wherein said step of cooling the ash comprises cooling the ash by heat exchange with at least part of the cooled gas removed from the retort.

5. A method in accordance with claim 4 wherein said step of cooling the gas removed from the retort further comprises cooling the gas by heat exchange with water.

6. A method in accordance with claim 5 and further comprising the step of further cooling the partially cooled combustion gases from the burner by heat exchange with water.

7. A method in accordance with claim 6 wherein said step of cooling the ash from the burner further comprises cooling by heat exchange with water.

8. A method in accordance with claim 7 wherein the same water is used to cool the ash, the combustion gases and the gases from the retort, and further comprising the step of preheating the tar sands by heat exchange with the heated water used to cool the ash, combustion gases and gases from said retort prior to feeding the tar sands to the retort.

9. A method in accordance with claim 4 and further comprising the step of feeding at least some of the gases removed from the retort and heated by heat exchange with the ash, to the burner along with the spent tar sands.

* * * * *